US009826852B2

(12) United States Patent
Lai

(10) Patent No.: US 9,826,852 B2
(45) Date of Patent: Nov. 28, 2017

(54) POP-UP TRAY

(71) Applicant: Connie Y. Lai, Cerritos, CA (US)

(72) Inventor: Connie Y. Lai, Cerritos, CA (US)

( * ) Notice: Subject to any disclaimer, the term of this patent is extended or adjusted under 35 U.S.C. 154(b) by 0 days.

(21) Appl. No.: 14/956,108

(22) Filed: Dec. 1, 2015

(65) Prior Publication Data

US 2017/0295974 A1 Oct. 19, 2017

(51) Int. Cl.
*A47G 19/30* (2006.01)
*A47G 23/06* (2006.01)
*B65D 5/20* (2006.01)

(52) U.S. Cl.
CPC ..... *A47G 23/06* (2013.01); *B65D 5/20* (2013.01)

(58) Field of Classification Search
CPC ..... A47G 2019/306
USPC ..... 248/37.3, 459, 174
See application file for complete search history.

(56) References Cited

U.S. PATENT DOCUMENTS 3,002,722 A * 10/1961 Cote ..... B65D 71/007 206/499
5,098,013 A * 3/1992 France ..... B65D 5/2028 206/551
5,884,783 A * 3/1999 Proulx ..... A47G 19/30 211/70.1

* cited by examiner

*Primary Examiner* — J. Gregory Pickett
*Assistant Examiner* — Allan Stevens
(74) *Attorney, Agent, or Firm* — Jen-Feng Lee, Esq.

(57) ABSTRACT

The present invention disclosed a serving or display tray that comes in a minimally stored size when in its collapsed state, which allows huge amount of such tray to be transported and stored, at a relatively low cost. When it is ready for use, it can easily unfold into its pop-up state where the two top distal portions of the top layer are overlappingly connected to the underside of the corresponding fold-up walls of the bottom layer, providing good side support to the fold-up walls when food items, or other decorative subjects, are placed in the tray.

3 Claims, 5 Drawing Sheets

POP-UP TRAY

FIELD AND BACKGROUND OF THE INVENTION

The present invention relates to a pop-up tray that has a flat configuration at the collapsed state. The tray can be easily unfolded into a pop-up tray that can be used to serve food items, or used as a display rack or tray, depending on consumers' need or preference.

Various fast-food restaurants use simple and disposable food dishes or trays that are made up of a simple stackable paper container, in the form of a shallow tray or dish. The problem with the current stackable tray is that it generally does not have good thermal-insulation characteristics and the depth of such tray is very shallow, generally not suitable for certain type of food items, such as tacos or waffle sandwiches.

To use a tray suitable for food items such as tacos or waffle sandwiches, the necessary structure to hold up the food items means that the tray needs to take up more spatial volume, which results in higher storage and transportation costs.

Also, many currently available disposable trays having the hold-up structure do not have good heat-insulation features, further creating user inconvenience when hot food is served.

SUMMARY OF THE INVENTION

Present invention disclosed a serving or display tray that comes in a minimally stored size when in its collapsed state. The collapsed tray takes the shape of a flat configuration, which allows huge amount of such tray to be transported and stored, and a relatively low cost.

When it is ready for use, it can easily unfold into its pop-up state where the two top distal portions are overlappingly connected to the underside of the corresponding fold-up walls, providing good side support to the fold-up walls when food item is placed in the tray.

In the preferred embodiment, the pop-up tray has a top layer planar structure and a bottom layer planar structure.

The top layer planar structure is further made up of a central flat portion, two fold-up walls, and two top distal portions.

In the preferred embodiment, the bottom layer planar structure is further made up of a bottom flat area and two bottom distal portions. Two bottom joints connect the bottom flat area and the two bottom distal portions.

The central flat portion is overlappingly and permanently connected to the bottom flat area.

As such, the transportation and storage of the pop-up trays will incur relatively low cost due to the reduced volume of the tray at its flat configuration when collapsed, as compared to other trays or containers that cannot be folded up or collapsed.

The pop-up tray can be made from suitable materials such as card board stock, corrugated paper or other material with some level of heat-insulation characteristics.

To achieve good storage attribute and good folding/bending functionality, the thickness of the planar structure material is preferably not more than a quarter of an inch.

DESCRIPTION OF THE DRAWINGS

The accompanying drawings, which are incorporated in and constitute a part of this specification, illustrate the preferred embodiments of the invention and together with the description, serve to explain the principles of the invention.

Such drawings are exemplary implementations of the invention as disclosed and are not limiting the scope of the claims as supported by the disclosure made herein.

Figure 1:
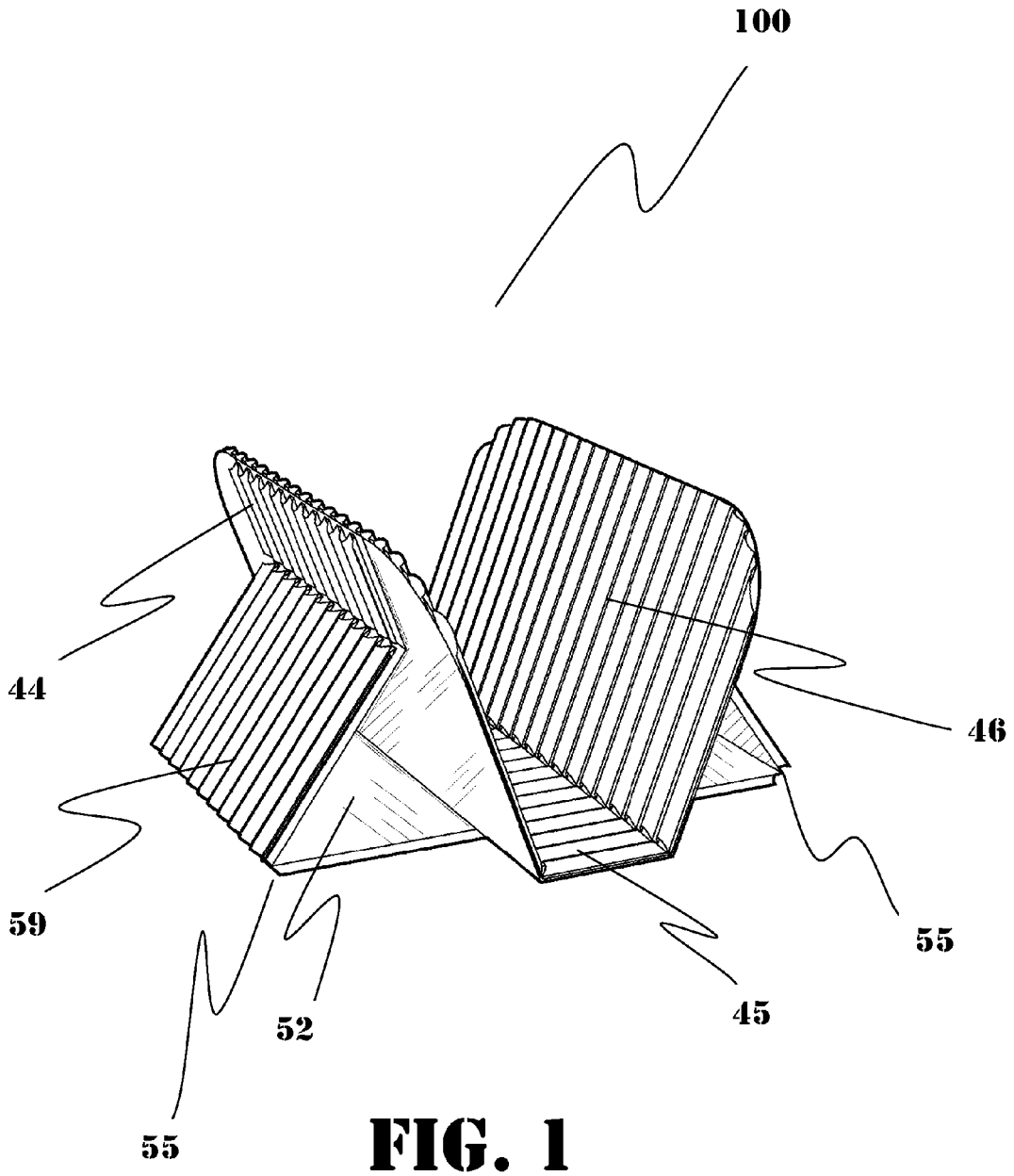

A brief description of the drawings is as follows:

FIG. 1 shows the perspective view of the pop-up tray in its unfolded state.

Figure 2:
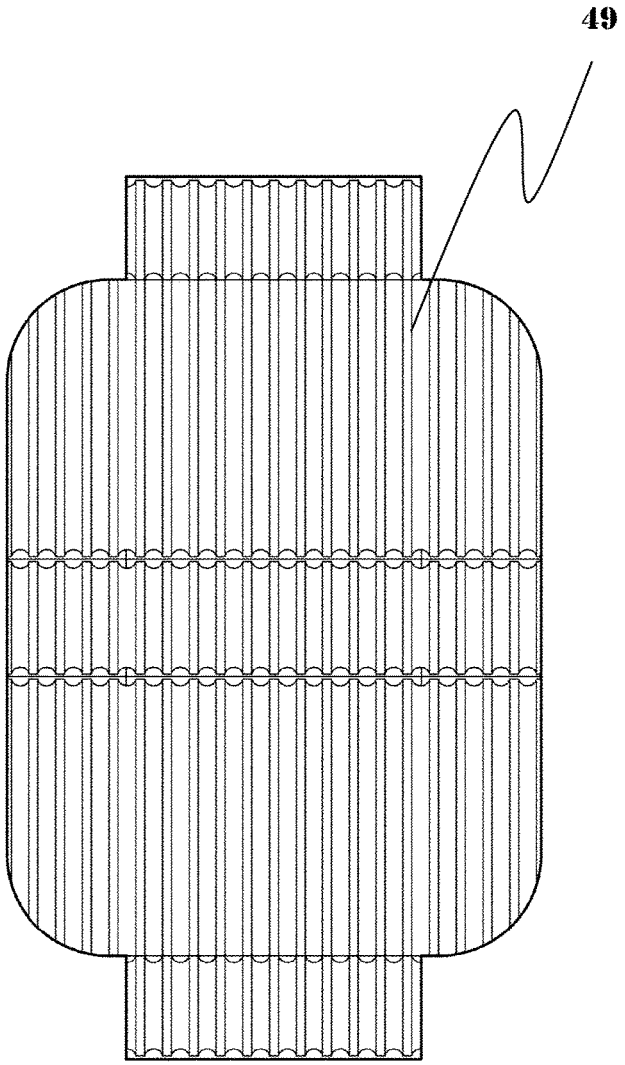

FIG. 2 shows the top view of the tray in its flat configuration of the collapsed state, with top layer planar structure in the front of the bottom layer planar structure.

Figure 3:
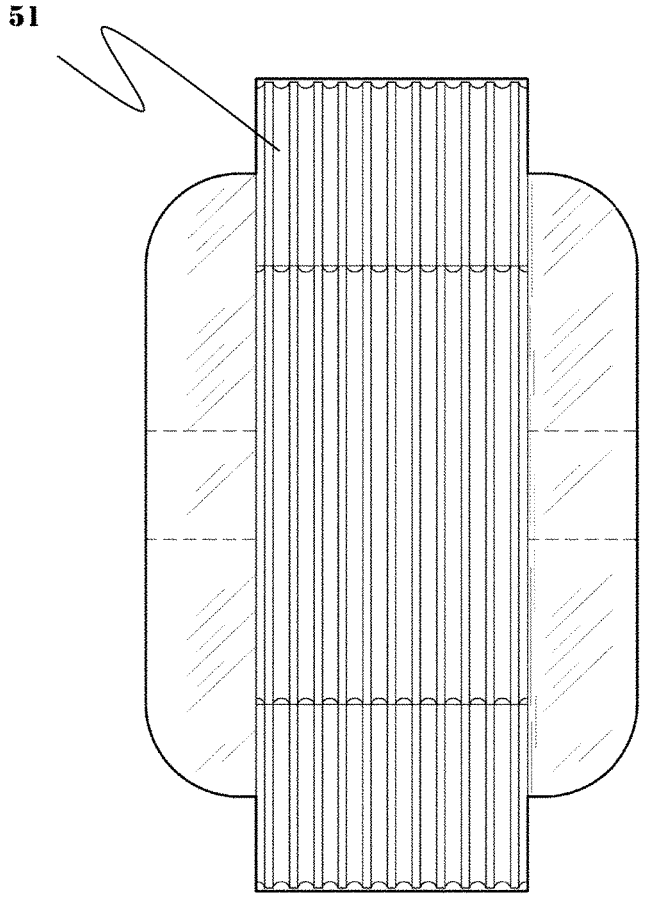

FIG. 3 shows the bottom view of try in the collapsed state, with bottom layer planar structure in the front of the top layer planar structure.

Figure 4:
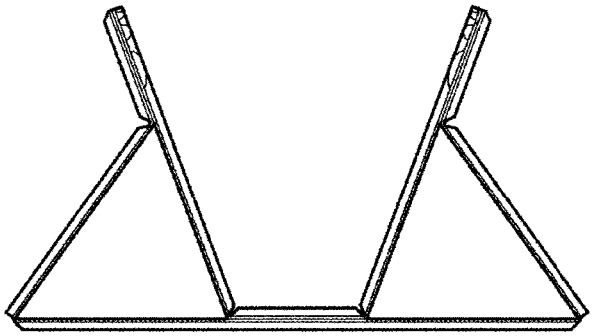

FIG. 4 shows the side view of the unfolded tray.

Figure 5:
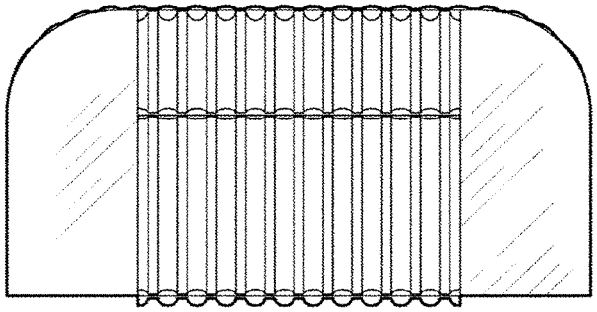

FIG. 5 shows the front view of the unfolded tray.

show the top-down view of the tray with different surface textures.

DETAILED DESCRIPTION OF THE PREFERRED EMBODIMENT

The present invention of the pop-up tray 100 is made up of a top layer planar structure 49 and a bottom layer planar structure 51.

FIGS. 2 and 3 show the full views of the top and bottom layer planar structures.

In the preferred embodiment, the top layer planar structure 49 is further made up of a central flat portion 45, two fold-up walls 46, and two top distal portions 44. As shown in FIG. 1, the fold-up walls 46 are hingeably connected to the central flat portion 45 and the top distal portions 44.

In the preferred embodiment, the bottom layer planar structure 51 is further made up of a bottom flat area 52 and two bottom distal portions 59. Two bottom joints 55 connect the bottom flat area 52 and the two bottom distal portions 59.

The Central flat portion 45 is overlappingly and permanently connected to the bottom flat area 52, as shown in FIGS. 1 and 4.

In the collapsed state, the pop-up tray 100 of present invention is in a flat configuration, as shown in FIGS. 2 and 3. As such, the transportation and storage of the pop-up trays will incur relatively low cost due to the reduced volume of the tray in the collapsed state, as compared to other trays or containers that cannot be folded up or collapsed.

The tip of said bottom distal portions 59 is connected to the tip of corresponding top distal portions 44. Reference FIGS. 1 and 4.

In a fully deployed state, the two top distal portions 44 will be connected overlappingly to an underside of the corresponding fold-up walls 46, as shown in FIGS. 1 and 4. As such, the bottom distal portion 59 form a support "strut" that pushes up the fold-up walls 46 and prevents the fold-up walls 46 from collapsing down when the weight of the object, food items, for example, tend to push down and outward.

The pop-up tray 100 of present application can be made from suitable materials such as card board stock, corrugated paper or other material with some level of heat-insulation characteristics.

Different surface textures can be used when different materials are applied to make the pop-up tray 100 of present invention.

To achieve good storage attribute and good folding/bending functionality, the thickness of the planar structure material is preferably not more than a quarter of an inch.

What is claimed is:

1. A pop-up tray, comprising:

a bottom layer planar structure having a bottom flat area and two bottom distal portions connected to said bottom flat area by two bottom joints, allowing the two bottom distal portions to be folded upward from the bottom flat area; and a top layer planar structure having a central flat portion, two fold-up walls, one on either side of said central flat portion, wherein each said fold-up wall further includes a top distal portion hingeably connected to a tip of the corresponding bottom distal portion of the bottom layer planar structure, wherein there are two top distal portions, wherein two top distal portions overlappingly contact respective undersides of the corresponding fold-up walls when the pop-up tray is in its fully deployed state.

2. The pop-up tray of claim 1, wherein the planar structure for either the bottom layer or the top layer is made from suitable structure having a thickness of not more than a quarter of an inch.

3. The pop-up tray of claim 1, wherein the planar structure for either the bottom layer or the top layer is made of corrugated material.

* * * * *